US009162797B1

(12) United States Patent
Suiter et al.

(10) Patent No.: US 9,162,797 B1
(45) Date of Patent: Oct. 20, 2015

(54) PALLET WITH TRAY STACKING STRUCTURE

(71) Applicant: SNYDER INDUSTRIES, INC., Lincoln, NE (US)

(72) Inventors: Rian Joseph Suiter, Lincoln, NE (US); William Jay Skinner, Westfield, IN (US)

(73) Assignee: SNYDER INDUSTRIES, INC., Lincoln, NE (US)

( * ) Notice: Subject to any disclaimer, the term of this patent is extended or adjusted under 35 U.S.C. 154(b) by 0 days.

(21) Appl. No.: 14/570,039

(22) Filed: Dec. 15, 2014

(51) Int. Cl.
*B65D 19/38* (2006.01)
*B65D 19/44* (2006.01)
*B65D 19/00* (2006.01)

(52) U.S. Cl.
CPC ..... *B65D 19/44* (2013.01); *B65D 19/004* (2013.01); *B65D 19/385* (2013.01); *B65D 2519/00034* (2013.01); *B65D 2519/00069* (2013.01); *B65D 2519/0094* (2013.01); *B65D 2519/00268* (2013.01)

(58) Field of Classification Search
USPC ..... 108/53.1, 53.3, 53.5, 55.1, 55.3, 901, 108/902
See application file for complete search history.

(56) References Cited

U.S. PATENT DOCUMENTS

| | | | | | |
|---|---|---|---|---|---|
| 3,526,195 | A * | 9/1970 | Maryonovich | ..... | 108/53.1 |
| 3,944,070 | A * | 3/1976 | Cardwell et al. | ..... | 108/53.1 |
| 4,263,855 | A * | 4/1981 | Lawlor | ..... | 108/53.3 |
| 4,619,207 | A * | 10/1986 | Boyce et al. | ..... | 108/53.3 |
| RE32,344 | E * | 2/1987 | Wind | ..... | 108/53.1 |
| 5,341,748 | A * | 8/1994 | Liu | ..... | 108/53.3 |
| 5,606,921 | A | 3/1997 | Elder et al. | | |
| 5,769,003 | A * | 6/1998 | Rose et al. | ..... | 108/55.3 |
| 5,857,416 | A * | 1/1999 | Donnell et al. | ..... | 108/55.3 |
| 6,705,236 | B1 | 3/2004 | Elder et al. | | |
| 7,607,628 | B2 | 10/2009 | Elder et al. | | |
| 8,511,239 | B2 * | 8/2013 | Lin | ..... | 108/57.25 |
| 2003/0209171 | A1 * | 11/2003 | Milles | ..... | 108/53.1 |
| 2004/0134390 | A1 * | 7/2004 | Apps et al. | ..... | 108/53.1 |
| 2007/0181045 | A1 * | 8/2007 | Smyers | ..... | 108/53.3 |
| 2010/0251940 | A1 * | 10/2010 | Jones et al. | ..... | 108/53.3 |
| 2012/0291677 | A1 * | 11/2012 | Lin | ..... | 108/53.3 |

* cited by examiner

*Primary Examiner* — Jose V Chen
(74) *Attorney, Agent, or Firm* — Hovey Williams LLP

(57) ABSTRACT

A pallet comprises a deck having an upper support surface; a plurality of support members depending from the deck; pallet stacking structure for retaining a second pallet stacked on the pallet, and tray retaining and stacking structure for retaining a tray on the pallet. The pallet stacking structure includes a plurality of first recessed regions formed in the upper support surface for receiving support members of a second pallet stacked on the first pallet. The tray retaining and stacking structure includes a plurality of second recessed regions formed in the upper support surface of the pallet for receiving the legs of a tray when the tray is supported on the pallet. The second recessed regions are formed within the outer boundaries of the first recessed regions and are deeper than the first recessed regions. The depths of the second recessed regions are slightly less than a length of the tray legs such that the bottoms of the tray legs touch the floors of the second recessed regions to transfer the weight of the trays downwardly through the tray legs and to the pallet rather than through the upper support surfaces of the tray.

18 Claims, 10 Drawing Sheets

PALLET WITH TRAY STACKING STRUCTURE

BACKGROUND

Pallets are often used for supporting and moving various types of articles. Pallets may be constructed from many different materials, including wood, metal, fiberglass or plastic, and are typically designed to be loaded and moved by forklifts, hand trucks, cranes or other specialized handling or loading equipment.

Most pallets have a deck with an upper support surface and a number of support members depending from the deck to elevate the deck and hence the articles supported on its upper surface above the ground to prevent moisture, dirt and other debris from coming into contact with the supported articles. When not in use, the pallets are often stacked to conserve floor space. Some pallets are therefore formed with pallet stacking structure that supports and stabilizes multiple pallets when stacked.

Pallets are often used to support trays that may be used to hold miscellaneous small objects such as fruit. The trays typically have an upper support surface with a circumscribing outer lip or wall and a number of legs that depend from the support surface to support the upper support surface above a pallet or other surface. The trays are typically designed to be stacked on top of one another such that a number of the trays may be supported on a single pallet. Unfortunately, when multiple trays are stacked on a pallet in this manner, the weight of the trays and the parts held in the trays can exert tremendous forces on the trays at the bottom of the stack and damage the trays. Such damage can be exacerbated by the pallet stacking structure described above because it often interferes with the proper placement and alignment of the trays on the pallet.

SUMMARY

The present invention solves the above-described problems and provides a distinct advance in the art of pallets by providing a pallet with both pallet stacking structure and tray retaining and stacking structure. The pallet stacking structure is integrated in the upper surface of the pallet deck and facilitates the stacking of multiple pallets when they are not in use. The tray retaining and stacking structure is also integrated in the upper surface of the pallet deck and facilitates the stacking of multiple trays on the pallet. Importantly, the pallet stacking structure and tray retaining and stacking structure are cooperatively designed and configured so as not to interfere with one another as described below.

A pallet constructed in accordance with one embodiment of the invention may be molded from plastic or other synthetic resin materials and broadly comprises a deck; a plurality of support members; the pallet stacking structure briefly described above; and the tray retaining and stacking structure briefly described above.

The deck has an upper support surface on which trays, other pallets, and other items may be supported. The support members, which may include runners, legs, or feet, depend from the bottom of the deck for elevating the deck above the ground.

An embodiment of the pallet stacking structure includes a plurality of first recessed regions formed in the upper support surface. The first recessed regions receive the support members of a second pallet stacked on the first pallet to "lock" adjacently stacked pallets together and prevent them from shifting laterally relative to one another.

An embodiment of the tray retaining and stacking structure includes a plurality of second recessed regions formed in the upper support surface of the pallet. The second recessed regions receive the legs of a tray supported on the pallet and prevent the tray, and any trays stacked on top the tray, from shifting laterally relative to the pallet.

Importantly, the pallet stacking structure and tray retaining and stacking structure are cooperatively designed and configured so as not to interfere with one another. Specifically, the second recessed regions of the tray retaining and stacking structure are formed within the outer boundaries of the first recessed regions of the pallet stacking structure and are deeper than the first recessed regions. This facilitates the alignment of trays on the pallet and reduces the likelihood that the tray legs will seat within the recesses of the pallet stacking structure.

The tray retaining and stacking structure is also designed and configured to more effectively support the weight of multiple stacked trays. Specifically, the depths of the second recessed regions are slightly less than the length of the tray legs so that the bottoms of the tray legs touch the floors of the second recessed regions and elevate the upper support surfaces of the trays slightly above the pallet. This transfers the weight of the trays, and the contents in the trays, downwardly through the tray legs and to the pallet rather than through the upper support surfaces of the trays. When multiple trays are stacked on top of one another, the weight of the trays is channeled linearly downwardly through all the tray legs and to the upper surface of the pallet. This is advantageous because the tray legs are typically thicker and stronger than the upper support surfaces of the tray and can therefore more effectively support and transfer the weight of the trays.

This summary is provided to introduce a selection of concepts in a simplified form that are further described in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
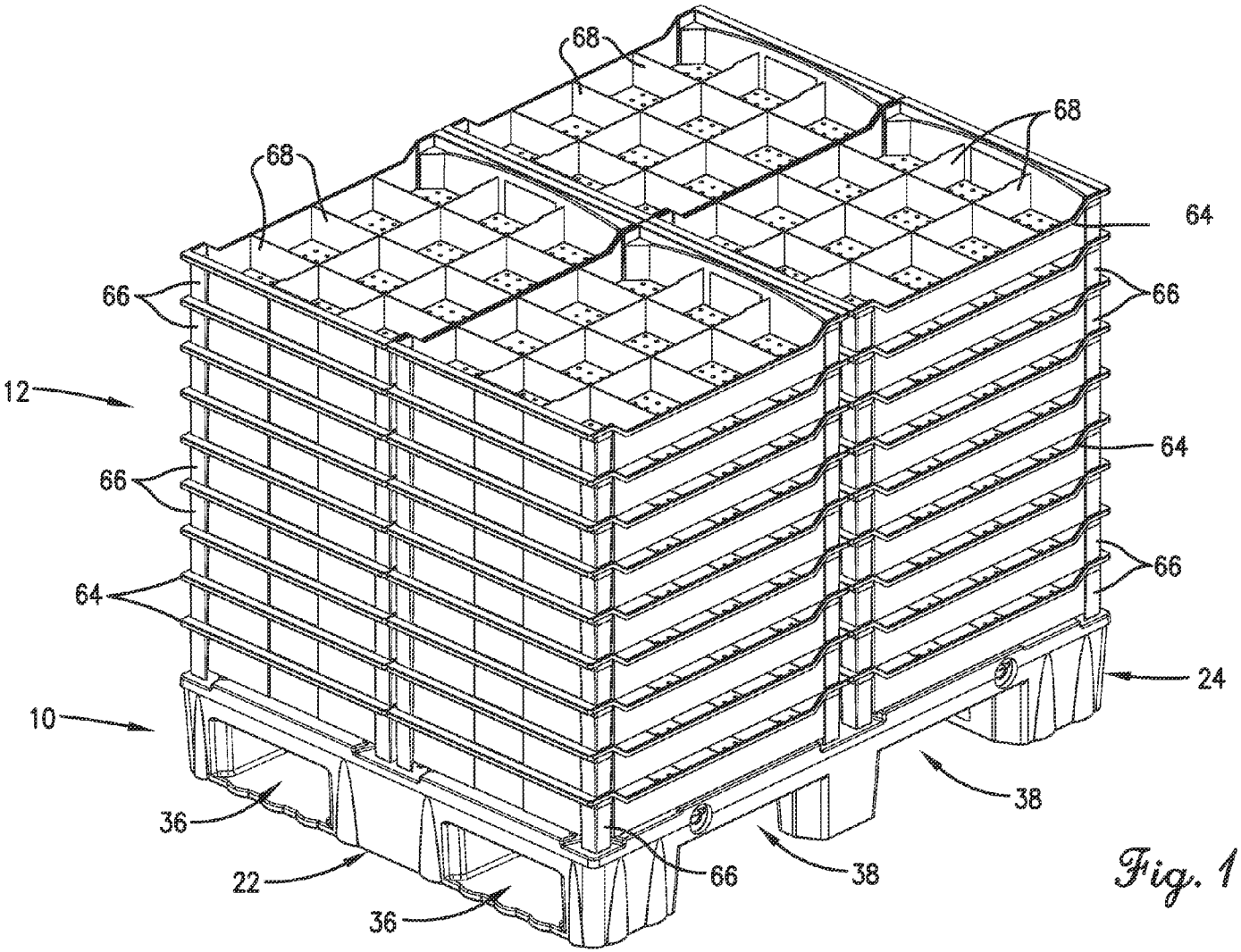
FIG. 1 is a perspective view of a pallet constructed in accordance with an embodiment of the present invention and shown with a number of trays stacked thereon.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of embodiments of the invention references the accompanying drawings. The embodiments are intended to describe aspects of the invention in sufficient detail to enable those skilled in the art to practice the invention. Other embodiments can be utilized and changes can be made without departing from the scope of the claims. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Referring now to the drawings, and initially to FIG. 1, a pallet 10 constructed in accordance with an embodiment of the invention is shown supporting a number of stacked trays 12. As described in more detail below, the pallet 10 is designed and configured such that forces associated with the weight of the trays, and any contents in the trays, are directed through the legs of the trays and to the upper support surface of the pallet. This allows the weight of the trays and their contents to be supported by the tray legs, which are designed to support such loads, rather than other parts of the trays, which are not designed to support heavy loads. The pallet is also configured to facilitate stacking with multiple other pallets when they are not in use. Importantly, the structure that facilitates the stacking of multiple pallets does not interfere with the structure that supports and retains the stacked trays, and vice versa, as described in more detail below.

An embodiment of the pallet 10 will now be described in more detail, primarily with reference to FIGS. 8 and 9. The pallet broadly comprises a deck 14; a plurality of support members 16 depending from the deck; pallet stacking structure, specific portions of which are numbered and described in detail below, for retaining a second pallet stacked on the pallet; and tray retaining and stacking structure, specific portions of which are numbered and described in detail below, for supporting and retaining one or more trays on the pallet. The pallet 10 may be made of any suitable materials and in one embodiment is rotationally molded from plastic or other synthetic resin materials.

Figure 10:
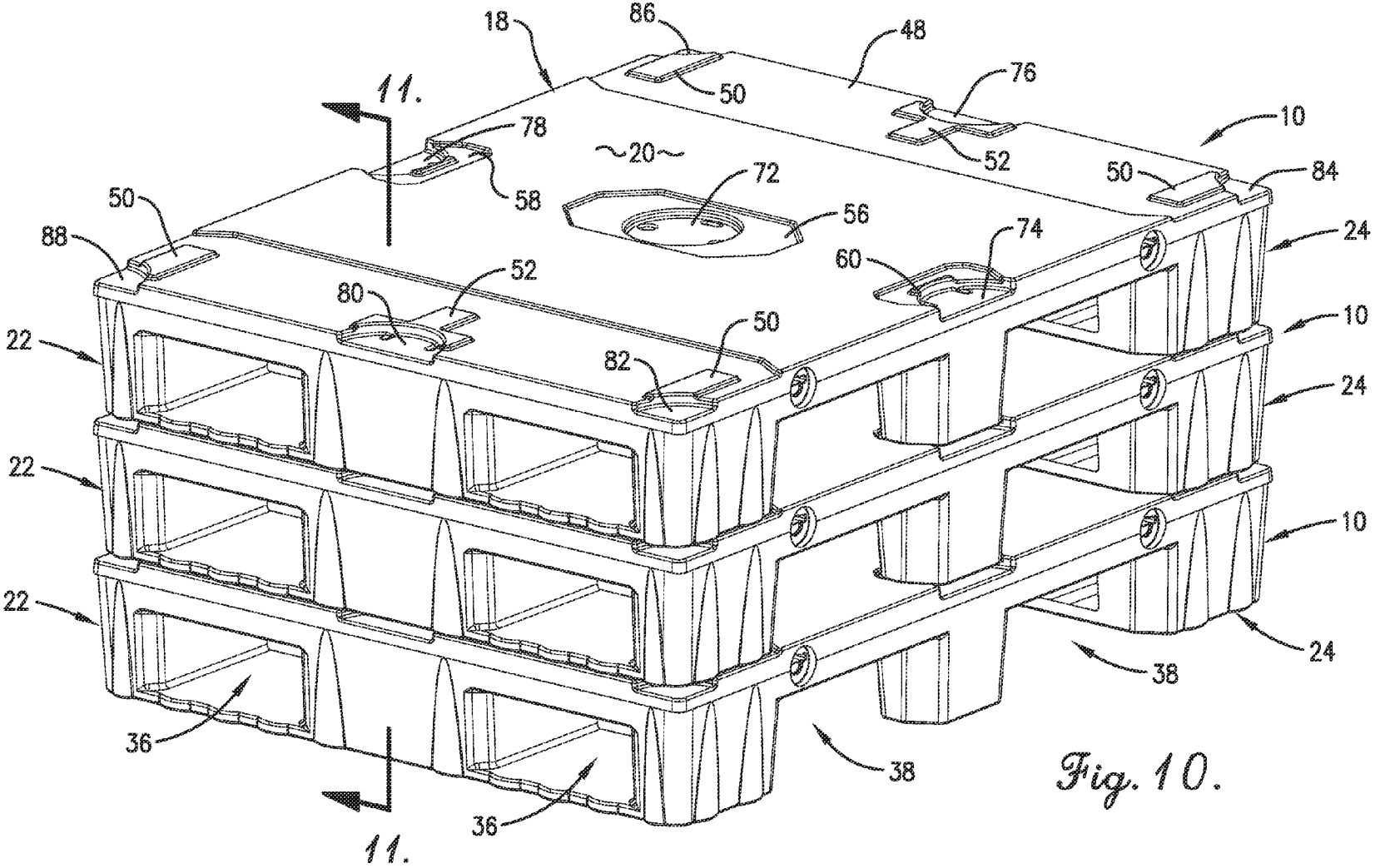
FIG. 10 is a perspective view of three pallets in a stacked configuration.

The deck 14 has an upper support surface 18 on which trays, other pallets, and/or other items may be supported as shown in FIGS. 1 and 10. The upper support surface 18 has a central, generally planar surface 20 and a number of recessed regions and projections that are described in more detail below. In one embodiment, the deck 14 is generally rectangular and approximately 47" long, 36" wide, and 2½" thick, but it may be formed in any shape and size without departing from the scope of the invention.

Figure 9:
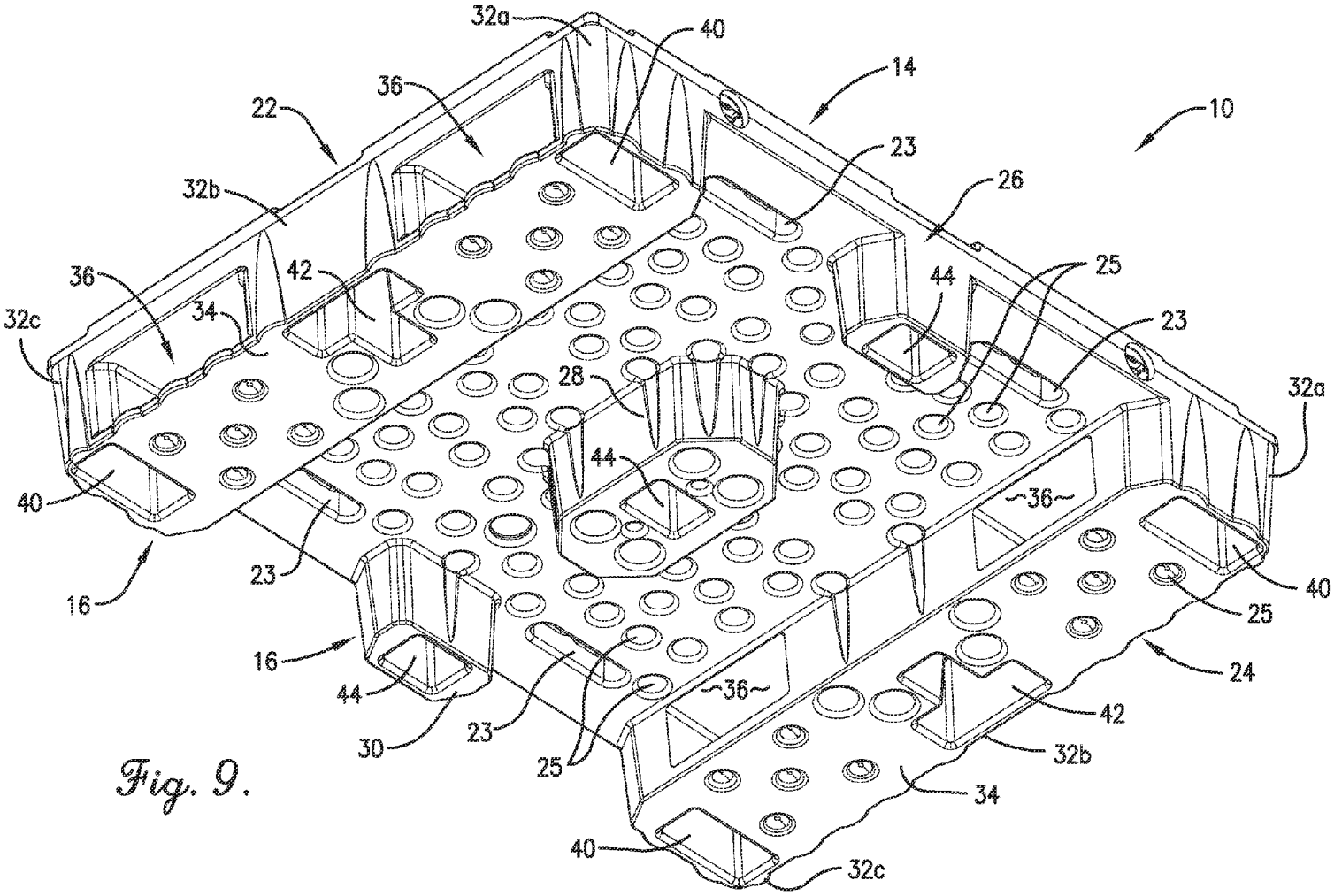
FIG. 9 is a bottom perspective view of the pallet.

As shown in FIG. 9, the underside of the deck 14 may include a number of molded handles 23 for use in handling the pallet 10 and a number of dimples 25 that provide structural support and reduce the weight of the pallet. The deck 14 may include other features not relevant to the present invention.

The support members depend 16 from the bottom of the deck 14 to elevate the deck and hence the trays or other articles supported on its upper surface 18 above the ground to prevent moisture, dirt and other debris from coming into contact with the supported articles. In one embodiment, the support members 16 consist of two runners 22, 24, positioned below opposite ends of the deck, and three center leg supports or feet 26, 28, 30 positioned below a center line of the pallet.

The runners 22, 24 each include three spaced-apart legs 32A, 32B, 32C, the bottoms of which are interconnected by a strap 34. The legs and strap of each runner cooperatively define two channels 36, also known as cores, extending through the runner. The cores 36 of the two runners are aligned and allow for insertion of forklift tines, pallet jacks or hand jacks for handling the pallets. The straps 34 are relatively thin, typically having a height on the order of ½", so that a pallet jack may be rolled over the top of the straps and inserted in the cores 36. The straps also provide structural support to the runners.

The center leg supports 26, 28, 30 are spaced between the sides of the pallet so as not to block insertion of forklift tines, pallet jacks or hand jacks in the cores 36 of the runners 22, 24. The center leg supports are also positioned about midway between the runners to create channels 38 extending between the sides of the pallet for insertion of forklift tines, pallet jacks or hand jacks. This allows fork lifts or pallet jacks to lift the pallet 10 from all four sides.

As best shown in FIG. 9, the bottoms of the straps 34 include recesses that nest with features on the upper support surface of an adjacent pallet when two or more pallets are stacked as described in more detail below. Specifically, the bottom of each strap 34 has two rectangular-shaped recesses 40 positioned on the ends of the strap and a T-shaped recess 42 positioned near the midpoint of the strap. Similarly, the bottom of each center leg support 26, 28, 30 includes a rectangular-shaped recess 44. In one embodiment, the recesses 40, 42, 44 are approximately 4½" deep.

An embodiment of the pallet stacking structure will now be described in more detail. The pallet stacking structure is formed in the upper surface 18 of the pallet deck 14 and facilitates stacking of multiple pallets when they are not in use. An embodiment of the pallet stacking structure includes a plurality of recessed regions, collectively referred to herein as "first recessed regions", formed in the upper support surface of the pallet deck for receiving the support members 16 of a second pallet stacked on top of the first pallet. The first recessed regions "lock" adjacently stacked pallets together and prevent them from sliding and shifting laterally relative to one another.

Figure 8:
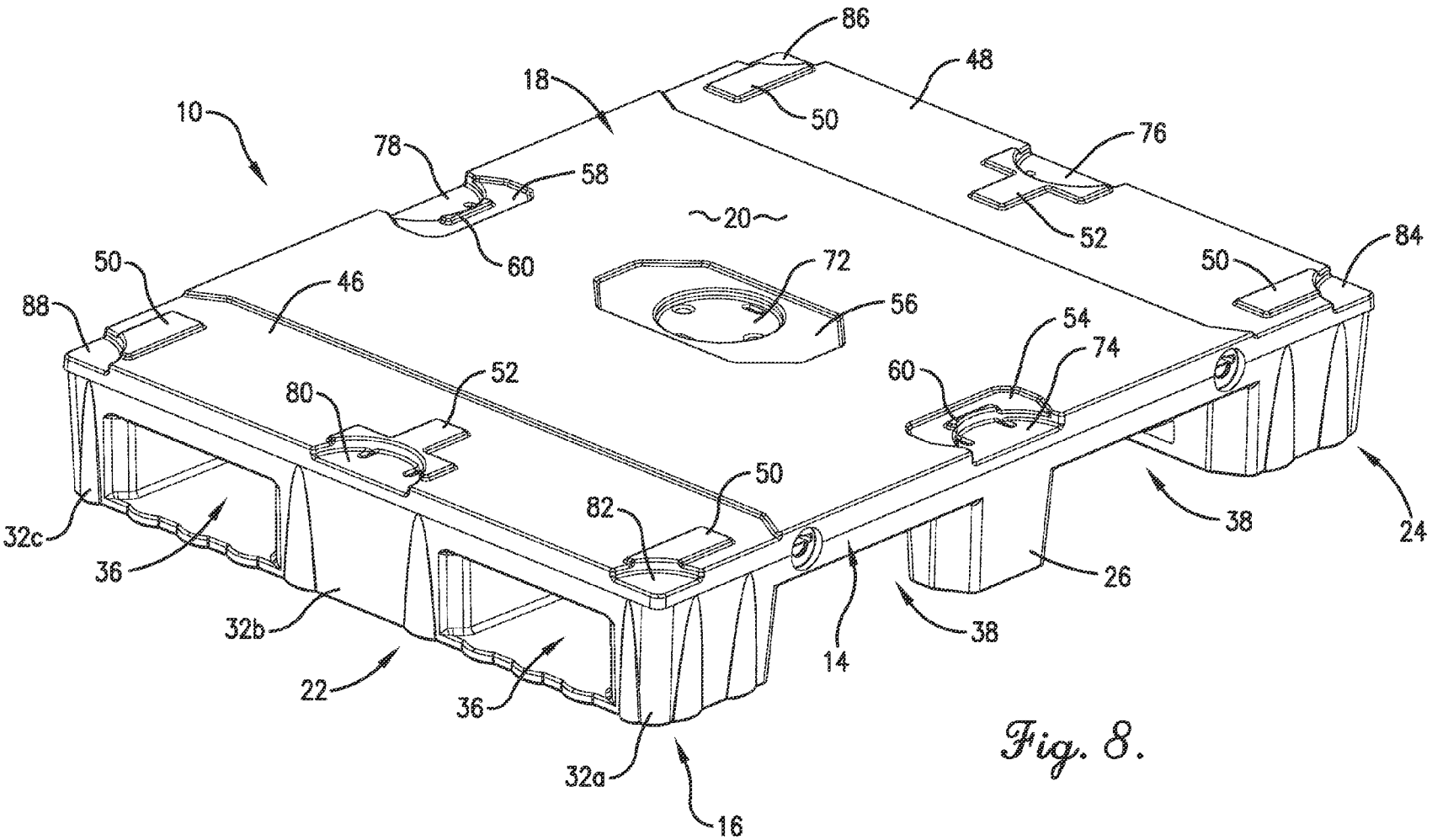
FIG. 8 is a top perspective view of the pallet without any trays supported thereon.

Embodiments of the first recessed regions are shown in FIG. 8 and include a pair of generally rectangular-shaped recesses 46, 48 on opposite ends of the pallet deck 14 that are sized and shaped to receive and nest with the bottoms of the runners 22, 24 of an adjacently stacked pallet. In one embodiment, the recesses 46, 48 are approximately 3/16" deep as measured from the deck's central planar surface 20. Two rectangular-shaped projections 50 and a T-shaped projection 52 extend upwardly from the floor of each recess 46, 48 for nesting within the two rectangular-shaped recesses 40 and the T-shaped recess 42 on the runners 22, 24 of an adjacently stacked pallet stacked. In one embodiment, the projections 50, 52 extends approximately 3/16" upwardly from the floor of each recess 46, 48 so that the projections 50, 52 are flush with and occupy the same plane as the deck's central planar surface 20.

The first recessed regions may also include three recesses 54, 56, 58 spaced along a centerline of the central surface 20 between the sides of the pallet deck. These recesses 54, 56, 58 are sized and shaped to receive and nest with the bottoms of the center leg supports 26, 28, 30 of an adjacently stacked pallet. As with the recesses, 46, 48 the recesses 54, 56, 58 are approximately 3/16" deep as measured from the deck's central planar surface 20. A rectangular-shaped projection 60 extends upwardly from the floor of each of the end recesses 54, 58 for nesting within one of the rectangular-shaped recesses 44 on the bottoms of the center leg supports 26, 30. In one embodiment, the projections 60 extend approximately 3/16" upwardly from the floor of each recess 54, 58 so that the projections are flush with and occupy the same plane as the deck's central planar surface 20. This maximizes the level surface area on the pallet while minimizing the areas of the recesses to limit the size of openings in which objects may fall.

Figure 11:
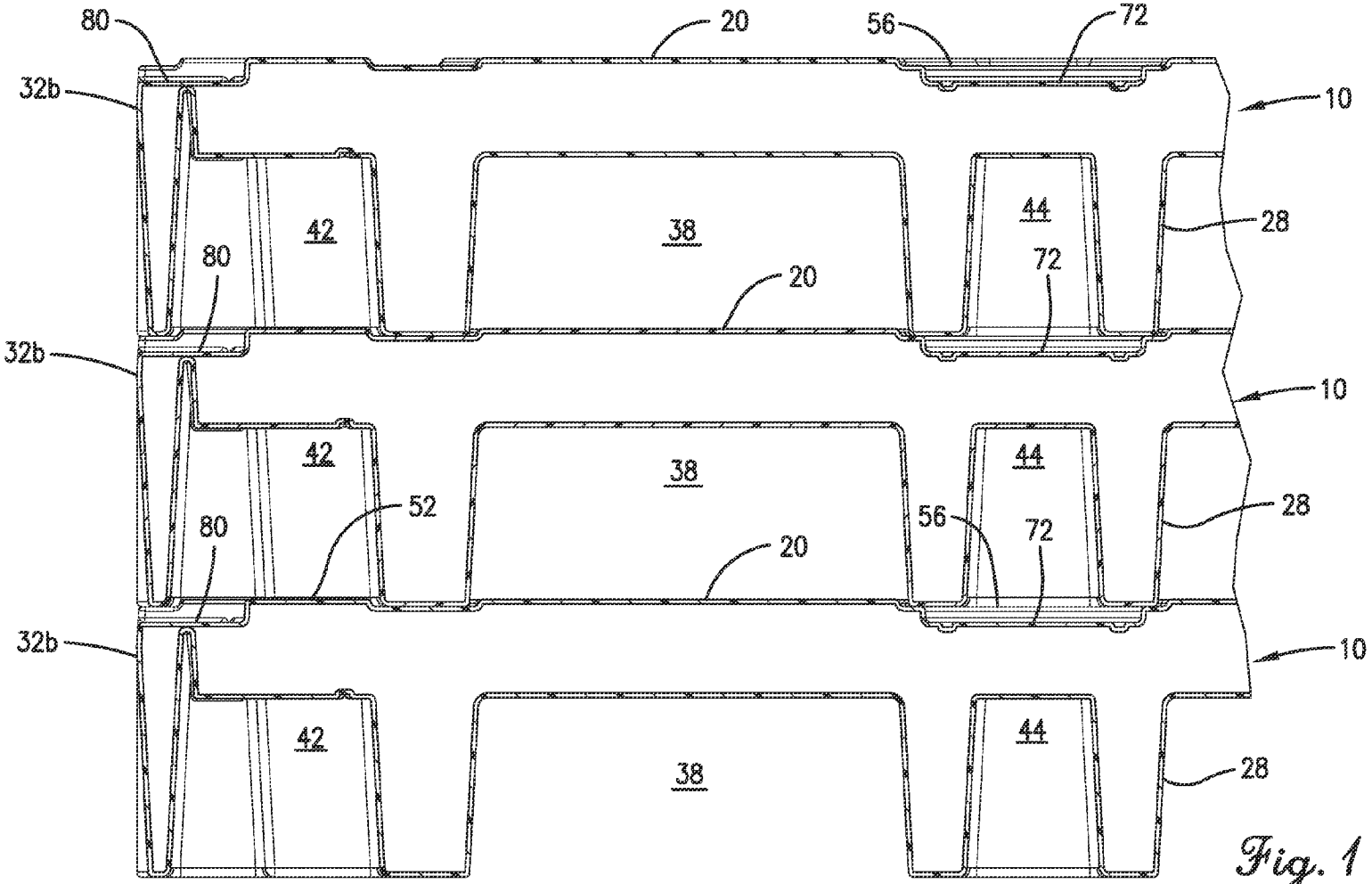
FIG. 11 is a fragmentary vertical sectional view of the three structured pallets taken along line 11-11 of FIG. 10.

The above-described pallet stacking structure allows multiple pallets to be stacked when not in use as shown in FIGS. 10 and 11. When stacked, the support members of an upper pallet nest within the first recessed regions of an adjacent lower pallet to align the pallets on top of one another and to prevent lateral shifting of the pallets relative to one another.

Embodiments of the tray retaining and stacking structure will now be described in more detail, primarily with reference to FIGS. 1-4, 7 and 8. The tray retaining and stacking structure is formed in the upper surface of the pallet deck 14 and supports and retains a stack of trays on the pallet and facilitates the proper transfer of forces exerted by the weight of the trays as described below.

Figure 5:
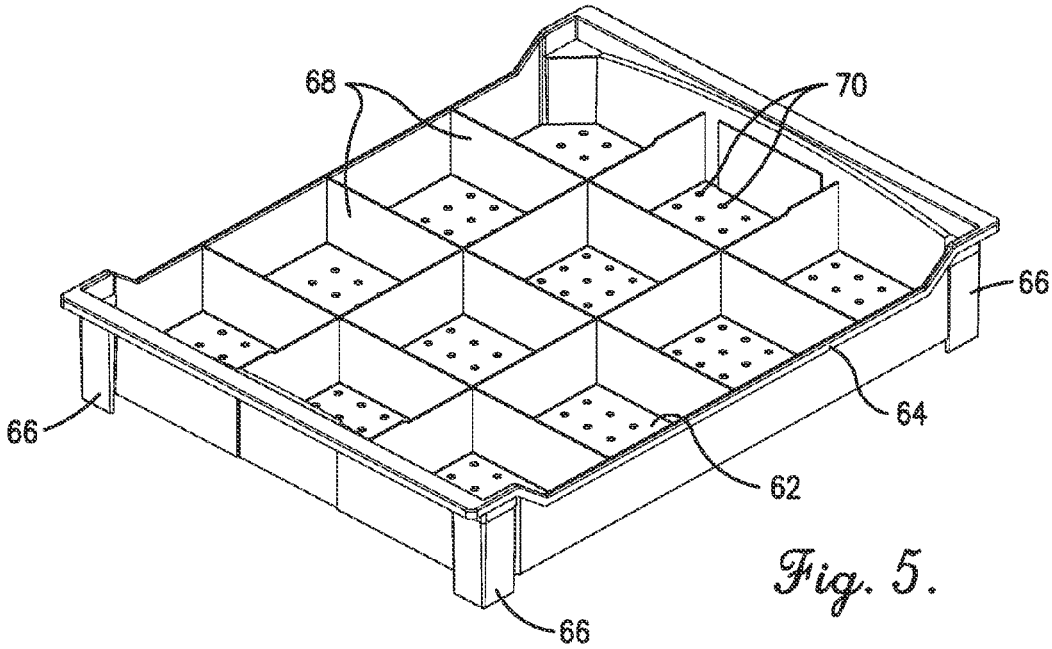
FIG. 5 is a top perspective view of an exemplary tray that may be placed on the pallet.
Figure 6:
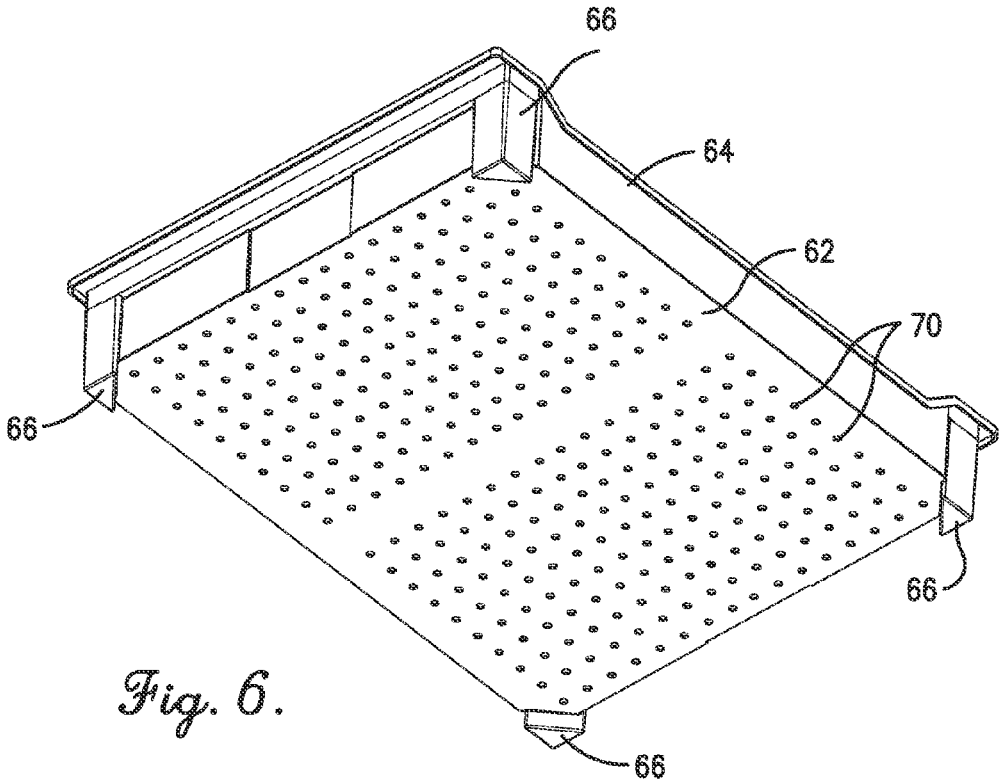
FIG. 6 is a bottom perspective view of the tray of FIG. 5.

Exemplary trays 12 that may be supported on the pallet are shown in FIGS. 5 and 6. The trays are conventional and may each include an upper support surface 62 with a circumscribing outer lip or wall 64 and a number of legs 66 that depend from the support surface to support the tray on a pallet or other surface. The upper support surface 62 may include dividers 68 for creating a number of smaller compartments and drainage holes 70. The trays may be of any shape and size, and in one embodiment, are approximately 23¼" long, 18" wide, and 4" tall such that four trays may be supported. The tray legs 66 may be of any shape and size, and in one embodiment, extend approximately 0.66" below the bottom of the support surface 62. As shown in the drawing figures, the tray legs may be configured to nest on top of the circumscribing wall 64 of an adjacent tray so that the trays may be stacked on top of one another.

Figure 4:
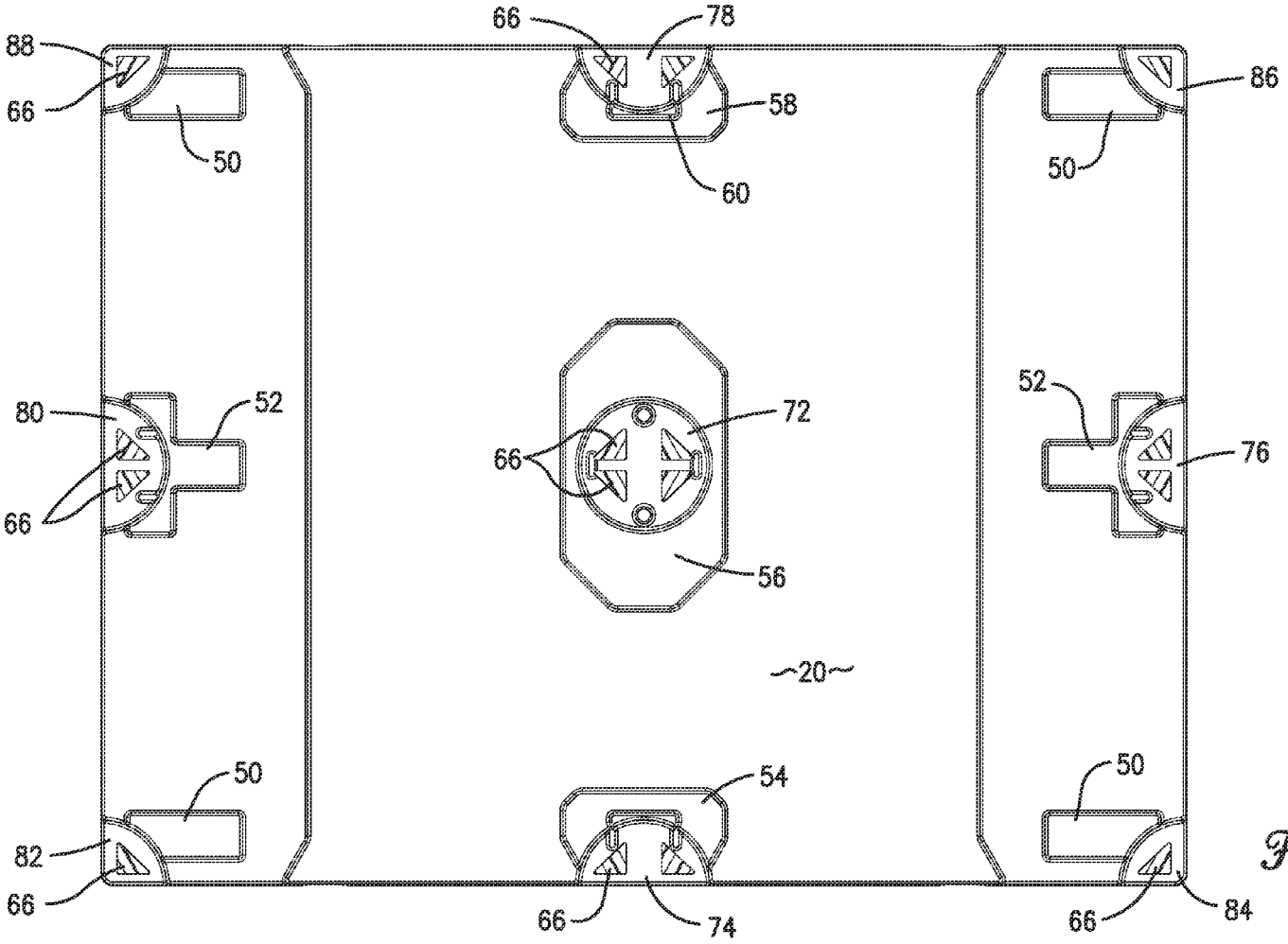
FIG. 4 is a top plan sectional view taken along line 4-4 of FIG. 2 and showing the upper support surface of the pallet and the feet of four trays supported on the pallet.
Figure 7:
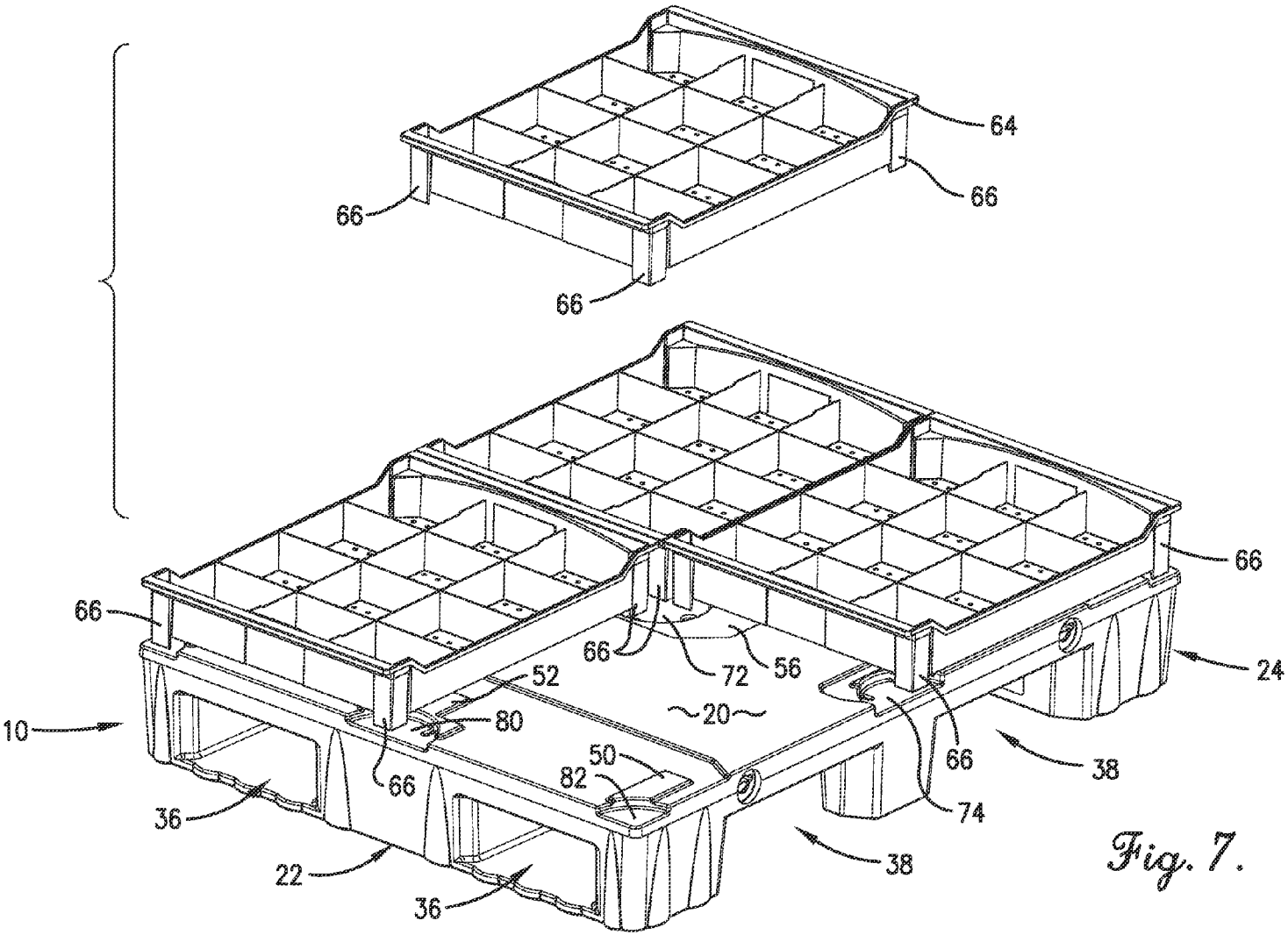
FIG. 7 is a perspective view of the pallet with three trays supported thereon and a fourth tray shown removed from the pallet.

An embodiment of the tray retaining and stacking structure includes a plurality of recessed regions, collectively referred to herein as "second recessed regions", formed in the upper support surface of the pallet for receiving the legs of a tray supported on the pallet. As best shown in FIGS. 4 and 8, the second recessed regions may include a circular-shaped recess 72; four semi-circular shaped recesses 74, 76, 78, 80; and four quarter circular shaped recesses 82, 84, 86, 88. The recesses may be formed in other shapes such as triangular shapes. The recess 72 is formed near a center point of the upper support surface, and as best shown in FIGS. 4 and 7, is sized and configured for simultaneously receiving the bottom of one leg 66 from four adjacent trays supported on the pallet. The recesses 74,76, 78, 80 are each formed near a midpoint of one side or end of the top of the pallet deck, and are each sized and configured for simultaneously receiving the bottom of one leg from two adjacent trays on the pallet. The recesses 82, 84, 86, 88 are each positioned near a corner of the top of the pallet deck, and are each sized and configured for receiving the bottom of one leg from one of the trays on the pallet.

In one embodiment, the above-described circular, semi-circular, and quarter circle recesses 72-88 each have a radius of 2 13/16" and a depth of 0.60" as measured from the central planar surface 20 of the pallet deck.

Importantly, the tray retaining and stacking structure is formed within the outer boundaries of the pallet stacking structure. Specifically, the recess 72 of the tray retaining and stacking structure is formed within the boundaries of the recess 56 of the pallet stacking structure; the recess 74 of the tray retaining and stacking structure is formed within the boundaries of the recess 54 of the pallet stacking structure; the recesses 76, 84, 86 of the tray retaining and stacking structure are formed within the boundaries of the recess 48 of the pallet stacking structure; the recess 78 of the tray retaining and stacking structure is formed within the boundaries of the recess 58 of the pallet stacking structure; and the recesses 80, 82, 88 of the tray retaining and stacking structure are formed within the boundaries of the recess 46 of the pallet stacking structure.

Also, the recesses of the second recessed regions are deeper than the recesses of the first recessed regions as measured from the central surface 20. The relative positioning and depths of the recesses of the tray retaining and stacking structure versus the recesses of the pallet stacking structure prevents the pallet stacking structure from interfering with the proper operation of the tray retaining and stacking structure. Specifically, when four trays are supported and centered on the pallet 10 in a single layer as shown in FIGS. 4 and 7, the tray legs align with the second recessed regions 72-88 of the tray retaining and stacking structure rather than the first recessed regions 46, 48, 54, 56, 58 of the pallet stacking structure so that the pallet stacking structure doesn't interfere with the operation of the tray retaining and stacking structure.

Figure 2:
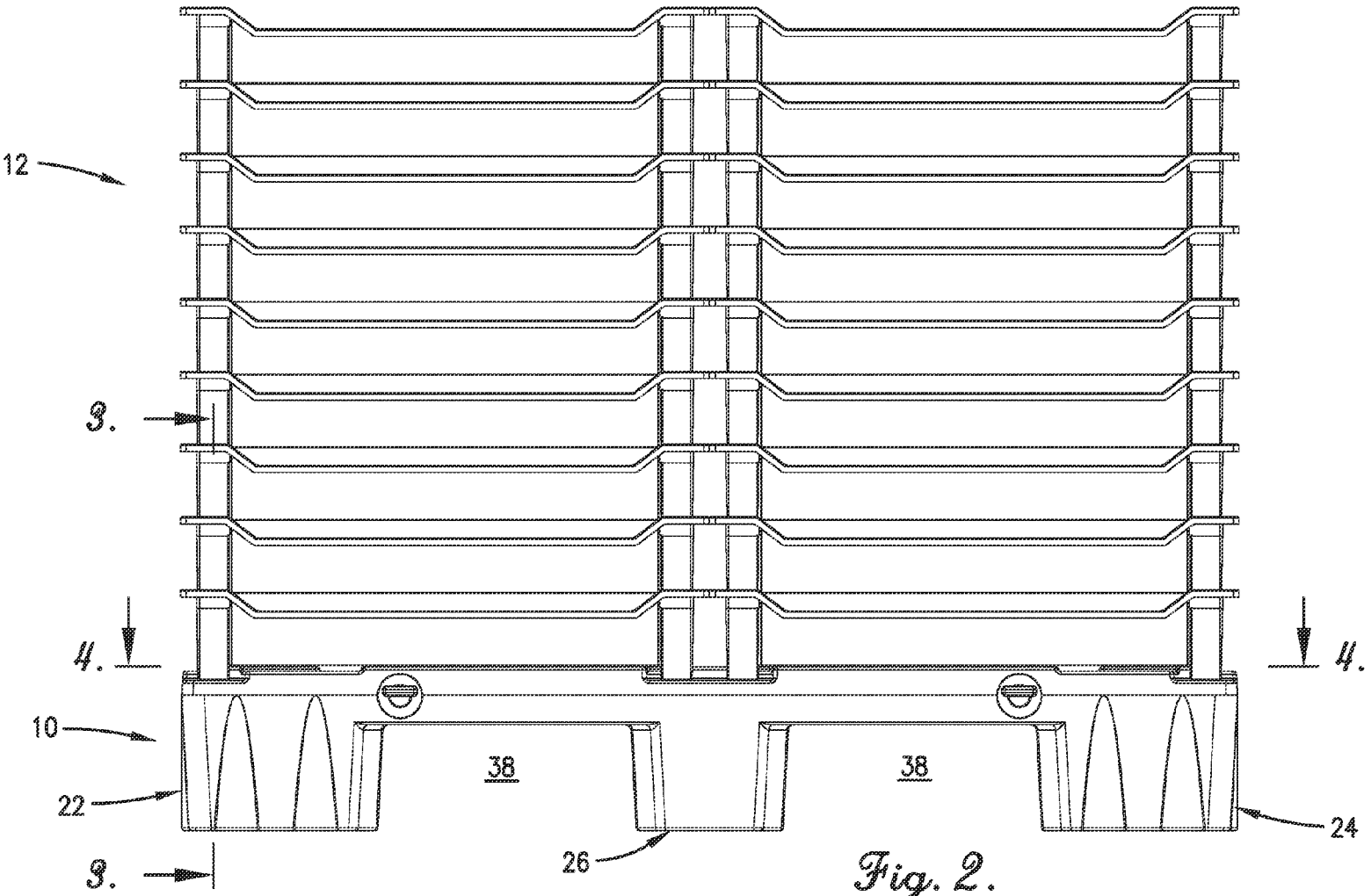
FIG. 2 is a side elevational view of the pallet and trays of FIG. 1.
Figure 3:
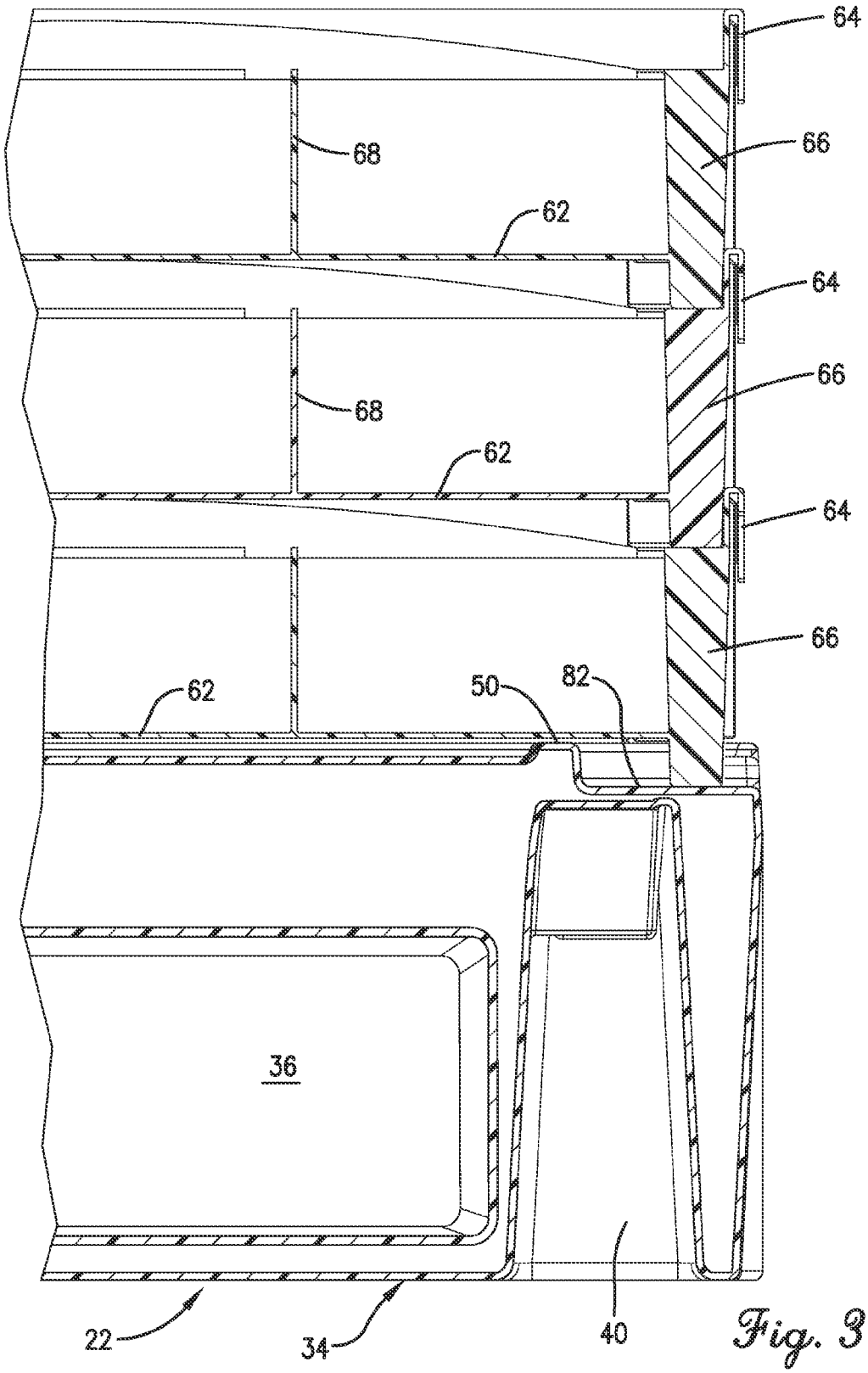
FIG. 3 is a fragmentary vertical sectional view of the pallet and trays taken along line 3-3 of FIG. 2.

The tray retaining and stacking structure is also designed and configured to more effectively direct and transfer the loads from the stacked trays to the pallet deck 14. As best depicted in FIGS. 2 and 3, the depths of the recesses 72-88 are slightly less than a length of the tray legs 66. This allows the bottoms of the tray legs to touch the floors of the second recessed regions and elevate the upper support surface of the tray slightly above the pallet, thus transferring forces related to the weight of the tray, and the parts held in the tray, downwardly through the tray legs and to the pallet rather than through the upper support surfaces of the tray. When multiple trays are stacked on top of one another, the weight of the trays is channeled linearly downwardly through all the tray legs and to the upper surface of the pallet. This is beneficial because the tray legs are typically thicker and stronger than the upper support surfaces of the tray.

In summary, above-described tray retaining and stacking structure prevents the trays 12 from shifting laterally relative to the pallet. The tray retaining and stacking structure also directs forces from the cumulative weight of multiple stacked trays downwardly thought the trays' legs 66 and on to the pallet deck 14 so that the trays aren't damaged as described below.

Although the invention has been described with reference to the preferred embodiment illustrated in the attached drawing figures, it is noted that equivalents may be employed and substitutions made herein without departing from the scope of the invention as recited in the claims. For example, the pallets, recessed areas, projections, and other features of the present invention may be formed of shapes and sizes and of materials not specifically disclosed herein without departing from the scope of the invention.

Having thus described the preferred embodiment of the invention, what is claimed as new and desired to be protected by Letters Patent includes the following:

1. A pallet for supporting at least one tray having legs, the pallet comprising:

a deck having an upper support surface;

a plurality of support members extending below the deck;

pallet stacking structure for facilitating stacking of a second pallet on the pallet, the pallet stacking structure including a plurality of pallet stacking recessed regions formed in the upper support surface of the deck for receiving support members of the second pallet when the second pallet is stacked on the deck of the pallet, the pallet stacking recessed regions having a first depth and each having an outer boundary; and tray retaining and stacking structure for retaining the at least one tray when supported on the pallet, the tray retaining and stacking structure including a plurality of tray stacking recessed regions formed within the outer boundaries of the pallet stacking recessed regions in the upper support surface of the deck such that the tray stacking recessed regions do not extend beyond the outer boundaries of the pallet stacking regions, the tray stacking recessed regions having a second depth greater than the first depth of the pallet stacking recessed regions and being configured to receive the legs of the at least one tray when the at least one tray is supported on the deck of the pallet.

2. The pallet as set forth in claim 1, wherein the tray stacking recessed regions each have a floor, the floors being configured to support the weight of the at least one tray through the tray legs when bottoms of the tray legs touch the floors.

3. The pallet as set forth in claim 1, wherein the plurality of tray stacking recessed regions includes multiple recesses that are circular, semi-circular, or quarter-circular in shape.

4. The pallet as set forth in claim 1, wherein the plurality of tray stacking recessed regions of the tray retaining and stacking structure comprises:

a circular-shaped recess near a center point of the upper support surface;

four semi-circular shaped recesses, each positioned near a midpoint of a side of the upper support surface; and four quarter-circular shaped recesses, each positioned near a corner of the upper support surface.

5. The pallet as set forth in claim 1, wherein the pallet stacking recessed regions are approximately 3/16" deep.

6. The pallet as set forth in claim 1, wherein the tray stacking recessed regions are approximately 0.60" deep.

7. The pallet as set forth in claim 1, wherein the pallet is formed of rotationally molded synthetic materials.

8. The pallet as set forth in claim 1, wherein the tray retaining and stacking structure permits multiple trays to be stacked on the pallet and directs forces related to the weight of the trays, and parts held in the trays, downwardly through the tray legs and to the tray stacking recessed regions.

9. A pallet for supporting at least one tray having legs, the pallet comprising:

a deck having an upper support surface;

a plurality of support members depending from the deck;

pallet stacking structure for retaining a second pallet stacked on the pallet, the pallet stacking structure including a plurality of pallet stacking recessed regions formed in the upper support surface of the deck for receiving support members of the second pallet when the second pallet is stacked on the pallet deck, the pallet stacking recessed regions having a first depth and each having an outer boundary; and tray retaining and stacking structure for retaining the at least one tray on the pallet, the tray retaining and stacking structure including a plurality of tray stacking recessed regions formed in the upper support surface for receiving the legs of the at least one tray when the at least one tray is supported on the pallet, wherein the tray stacking recessed regions are formed within the outer boundaries of the pallet stacking recessed regions such that the tray stacking recessed regions do not extend beyond the outer boundaries of the pallet stacking regions, the tray stacking recessed regions having a second depth greater than the first depth of the pallet stacking recessed regions, each tray stacking recessed region having a floor, the floors being configured to support the weight of the at least one tray through the tray legs when the bottoms of the tray legs touch the floors of the tray stacking recessed regions.

10. The pallet as set forth in claim 9, wherein the tray stacking recessed regions include a plurality of recesses that are circular, semi-circular, or quarter-circular in shape.

11. The pallet as set forth in claim 9, wherein the plurality of tray stacking recessed regions of the tray retaining and stacking structure comprises:

a circular-shaped recess near a center point of the upper support surface;

four semi-circular shaped recesses, each positioned near a midpoint of a side of the upper support surface; and four quarter-circular shaped recesses, each positioned near a corner of the upper support surface.

12. The pallet as set forth in claim 9, wherein the pallet stacking recessed regions are approximately 3/16" deep.

13. The pallet as set forth in claim 9, wherein the tray stacking recessed regions are approximately 0.60" deep.

14. The pallet as set forth in claim 9, wherein the pallet is formed of rotationally molded synthetic materials.

15. The pallet as set forth in claim 9, wherein the tray retaining and stacking structure permits multiple trays to be stacked on the pallet and directs forces related to the weight of the trays, and parts held in the trays, downwardly through the tray legs and to the tray stacking recessed regions.

16. A pallet for supporting at least one tray having legs, the pallet comprising:

a deck having an upper support surface;

a plurality of support members depending from the deck;

pallet stacking structure for retaining a second pallet stacked on the pallet, the pallet stacking structure including a plurality of pallet stacking recessed regions fonned in the upper support surface of the deck for receiving support members of the second pallet when the second pallet is stacked on the pallet, the pallet stacking recessed regions having a first depth and each having an outer boundary; and tray retaining and stacking structure for retaining the at least one tray when supported on the pallet, the tray retaining and stacking structure including a plurality of tray stacking recessed regions including a circular-shaped recess near a center point of the upper support surface, four semi-circular shaped recesses, each positioned near a midpoint of a side of the upper support surface, and four quarter-circular shaped recesses, each positioned near a corner of the upper support surface, the plurality of tray stacking recessed regions being formed in the upper support surface for receiving the legs of the at least one tray when the at least one tray is supported on the pallet, wherein the tray stacking recessed regions are formed within the outer boundaries of the pallet stacking recessed regions such that the tray stacking recessed regions do not extend beyond the outer boundaries of the pallet stacking recessed regions, the tray stacking recessed regions having a second depth greater than the first depth of the pallet stacking recessed regions, each tray stacking recessed region having a floor, the floors being configured to support the weight of the at least one tray through the tray legs when bottoms of the tray legs touch the floors of the tray stacking recessed regions.

17. The pallet as set forth in claim 16, wherein the pallet is formed of rotationally molded synthetic materials.

18. The pallet as set forth in claim 16, wherein the tray retaining and stacking structure permits multiple trays to be stacked on the pallet and directs forces related to the weight of the trays, and parts held in the trays, downwardly through the tray legs and to the deck of the pallet.

* * * * *